US005406925A

United States Patent [19]

Lin

[11] Patent Number: 5,406,925

[45] Date of Patent: Apr. 18, 1995

[54] FUEL ENGINE COMBUSTION AID FOR A LEAN-BURNING

[76] Inventor: Fu-Kuo Lin, No. 14, Lane 21, Chang-Chun Rd., Hsintien City, Taipei Hsien, Taiwan, Prov. of China

[21] Appl. No.: 279,353

[22] Filed: Jul. 25, 1994

[51] Int. Cl.[6] ..... F02B 47/08

[52] U.S. Cl. ..... 123/573

[58] Field of Search ..... 123/572, 573, 574

[56] References Cited

U.S. PATENT DOCUMENTS

| | | | |
|---|---|---|---|
| 3,820,518 | 6/1974 | Dolfi | 123/573 |
| 3,923,024 | 12/1975 | Dabrio | 123/573 |
| 4,183,336 | 1/1980 | Norman | 123/572 |
| 4,204,504 | 5/1980 | Dabrio | 123/573 |
| 4,305,369 | 12/1981 | Norman | 123/574 |

*Primary Examiner*—Henry C. Yuen
*Assistant Examiner*—M. Macy
*Attorney, Agent, or Firm*—Morton J. Rosenberg; David I. Klein

[57] ABSTRACT

A fuel engine combustion aid having a first guide hole connected to the positive crankcase ventilation pipe of a fuel engine, a second guide hole connected to the intake manifold of the fuel engine and having a middle part communicated with the first guide hole, an air chamber at one side mounted with an air filter box, a valve chamber communicated between the air chamber and the second guide hole, a valve installed in the valve chamber and controlled by the fuel engine to let fresh air be drawn through the air chamber and the valve chamber into the second guide hole then into the positive crankcase ventilation pipe via the first guide hole upon each intake stroke of the fuel engine.

4 Claims, 5 Drawing Sheets

FUEL ENGINE COMBUSTION AID FOR A LEAN-BURNING

BACKGROUND OF THE INVENTION

The present invention relates to a fuel engine combustion aid for a lean-burning which greatly improves the combustion efficiency of a fuel engine so as to increase the horsepower and reduce the amount of exhaust gas.

Various economizers have been disclosed for fuel engines, and have appeared on the market. These economizers are commonly complicated and expensive. Before the installation of a conventional economizer, the carburetor must be dismantled. After the installation of an economizer, the carburetor must be properly installed again. Any minor error during the installation of the carburetor may cause an oil leakage. Furthermore, because conventional economizers must be mounted around the exhaust manifold, they may be heated to deform or to break easily, causing the users dare not use the economizers.

SUMMARY OF THE INVENTION

It is one object of the present invention to provide a fuel engine aid which is simple in structure. It is another object of the present invention to provide a fuel engine aid which is easy to install without any special training. It is still another object of the present invention to provide a fuel engine aid which facilitates the mixing of air with fuel gas so as to improve the combustion efficiency of the fuel engine and to reduce the amount of exhaust gas.

DETAILED DESCRIPTION OF THE PREFERRED EMBODIMENT

Figure 1:
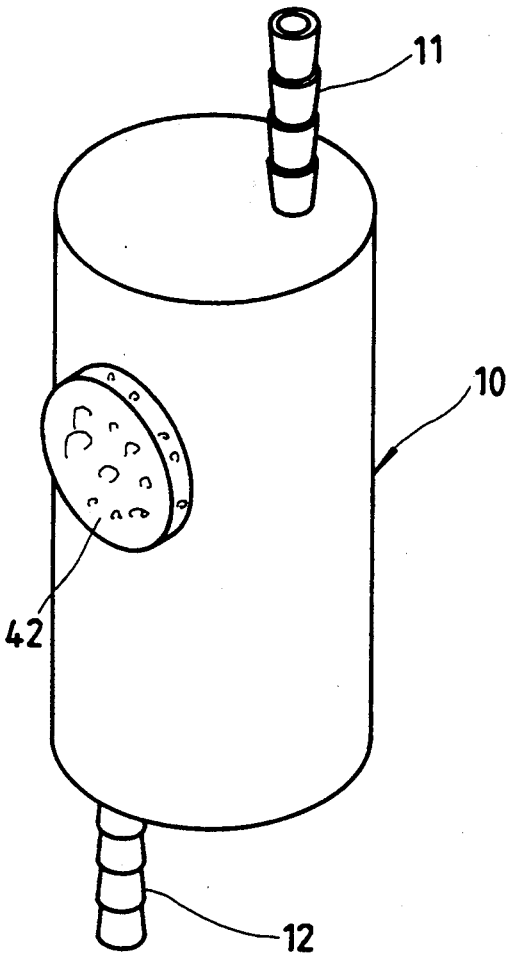
FIG. 1 is an elevational view of a combustion aid according to the present invention.
Figure 2:
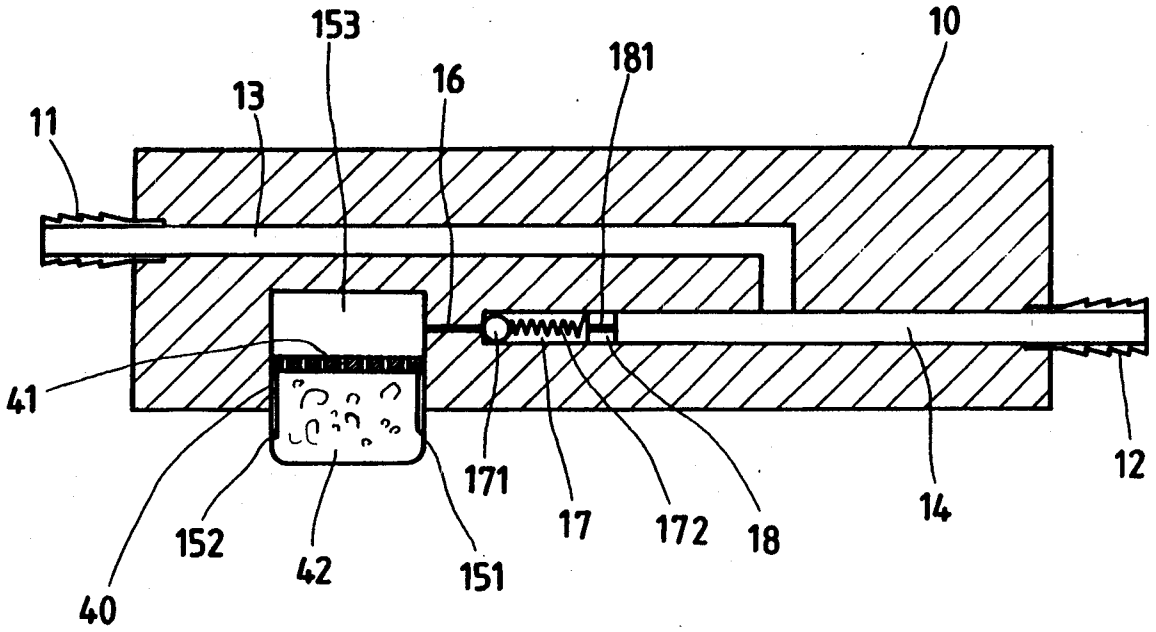
FIG. 2 is a longitudinal view in section of the combustion aid shown in FIG. 1.
Figure 3:
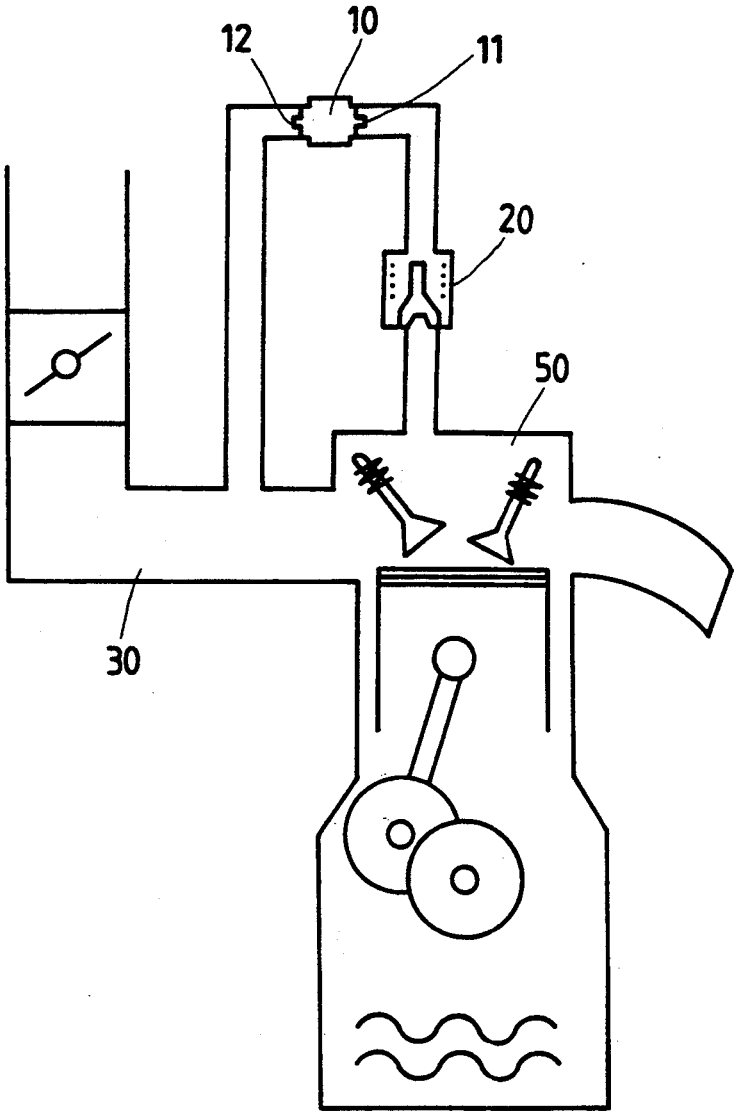
FIG. 3 is an installed view showing the position of the combustion aid of the present invention in the fuel engine system.

Referring to FIGS. 1, 2, and 3, a combustion aid in accordance with the present invention is generally comprised of an enclosed casing 10 having a first connector 11 for coupling the PCV (positive crankcase ventilation) pipe 20 and a second connector 12 for connection to the intake manifold 30 of the engine so that fresh air can be guided into the engine 50 for combustion. The first connector 11 is communicated with a first guide hole 13. The first guide hole 13 has a rear end 131 turned at right angles and perpendicularly linked to a second guide hole 14. An air chamber 153 is made on one side of the casing 10. An air filter box 40 is mounted within the air chamber 151 and retained in position by flanges 151 and 152, having a plurality of through holes 41 at the bottom for letting outside air enter the air chamber 151. The air filter box 40 is stuffed with sponge 42 and partially projects out of the casing 10. Through the sponge 42, outside air is guided into the air chamber 153. The air chamber 153 communicates with the second guide hole 14 through an air hole 16 and a valve chamber 17. A valve seat 18 is installed in the valve chamber 17 to hold a spring 172 and a ball 171. The valve seat 18 has a needle hole 181 communicated between the second guide hole 14 and the air hole 16. The ball 171 is supported on the spring 172 to block up the air hole 16. During the intake stroke, the ball 171 is moved away from the air hole 16 by the suction force of the fuel engine, permitting fresh outside air to be drawn from the air chamber 151 through the air hole 16 and the needle hole 181 into the second guide hole 14 and then into the fuel engine. During the exhaust stroke, the ball 171 is pushed back by the spring 172 to stop the air hole 16 again.

According to test, the content of carbon monoxide and hydrocarbon in the exhaust gas can be reduced to as low as about 1% and about 200 ppm respectively, and therefore the performance of the fuel engine is greatly improved.

Figure 4:
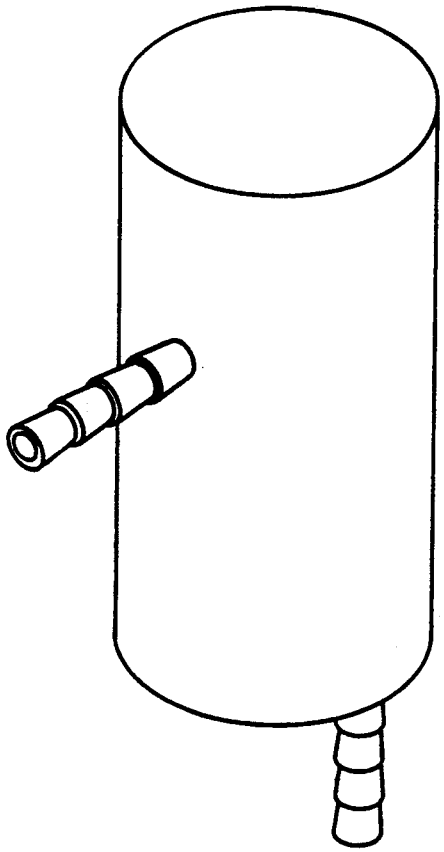
FIG. 4 is an elevational view of an alternate form of the combustion aid according to the present invention.
Figure 5:
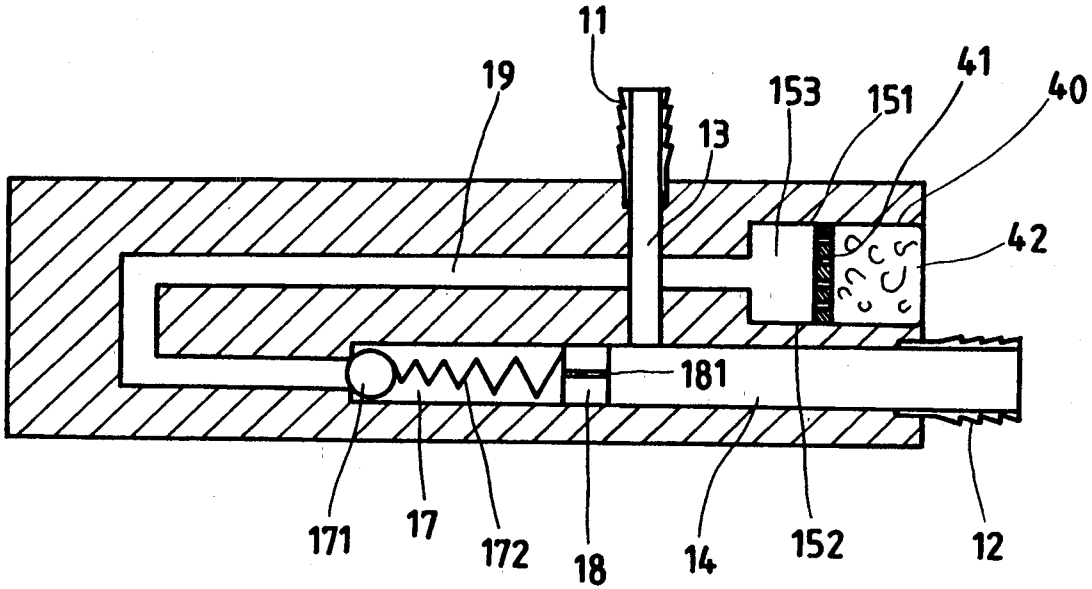
FIG. 5 is a longitudinal view in section of an alternate form of the combustion air of the present invention.

Referring to FIGS. 4 and 5, therein illustrated is an alternate form of the present invention. In this alternate form, the air chamber 153 is disposed in parallel with the second guide hole 14; a third guide hole 19 is provided having one end linked to the air chamber 153 and an opposite end turned through 180° angle and linked to the second guide hole 14 through the valve chamber 17. This arrangement allows more fresh air to be drawn into the fuel engine.

Figure 6:
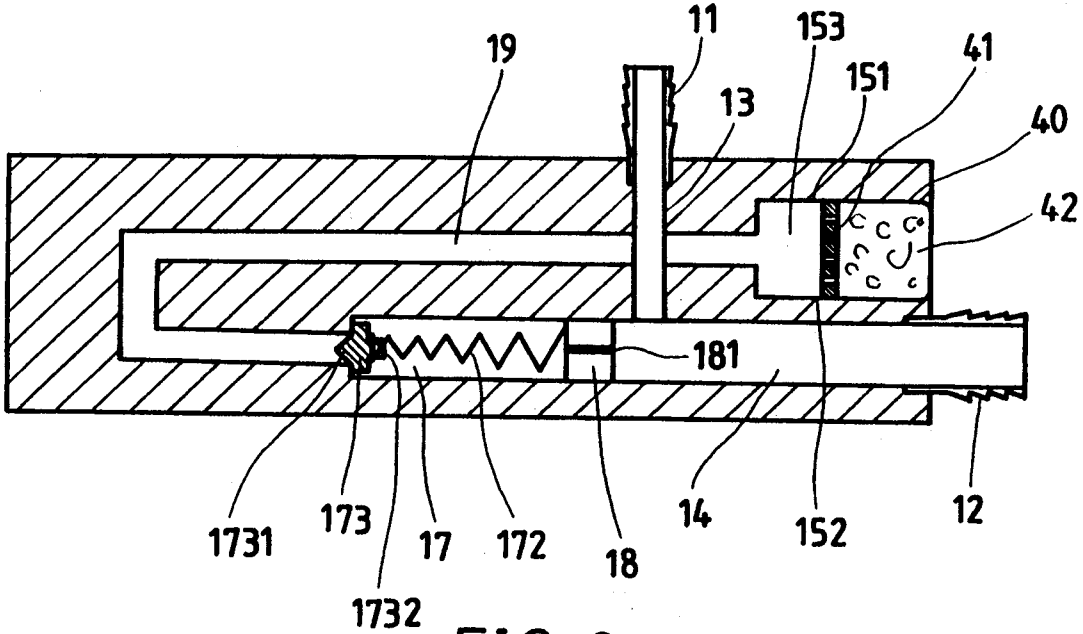
FIG. 6 is a longitudinal view in section of another alternate form of the combustion aid of the present invention.

FIG. 6 illustrates another alternate form of the present invention. This alternate form is similar to that shown in FIG. 5 with the exception of the installation of the valve control element 173, which replaces the ball 171 shown in FIG. 5. The valve control element 173 has a rear flange 1732 connected to the spring 172 and a tapered tip 1731 moved to control the passage between the valve chamber 17 and the third guide hole 19.

What is claimed is:

1. A fuel engine combustion aid, comprising:

a casing having a first connector connected to the positive crankcase ventilation pipe of a fuel engine, a second connector connected to the intake manifold of the fuel engine, a first guide hole, a valve chamber, a second guide hole communicated between said second connector and said valve chamber, an air chamber, an air hole communicated between said air chamber and said valve chamber, said first guide hole having one end connected to said first connector and an opposite end turned at right angles and perpendicularly connected to said second guide hole;

valve means installed in said valve chamber and reciprocated by the fuel engine to alternatively open and close the passage between said air hole and said second guide hole; and air filter means mounted within said air chamber for letting outside air be drawn into said second guide hole through said air hole and said valve chamber upon each intake stroke of the fuel engine.

2. The fuel engine combustion aid of claim 1 wherein said valve means comprises a valve seat having a needle hole for letting air pass from said air hole into said second guide hole, a spring connected to said valve seat, and a ball supported on said spring and reciprocated to stop and open said air hole alternatively.

3. The fuel engine combustion aid of claim 1 wherein said air valve means comprises a valve seat having a needle hole for letting air pass from said air hole into said second guide hole, a spring connected to said valve seat, and a valve control element having a flange at a rear end connected to said spring and a tapered tip at a front end moved to stop and open said air hole alternatively.

4. The fuel engine combustion aid of claim 1 wherein said air filter comprises a box having a front open end disposed outside said casing and a rear closed end disposed inside said air chamber, and a sponge filled in said box to remove particles from air passing through, said rear closed end of said box having through holes for passing air.

* * * * *